US009057219B1

(12) United States Patent
Williamson et al.

(10) Patent No.: US 9,057,219 B1
(45) Date of Patent: Jun. 16, 2015

(54) WINDOW COVERING WITH INTEGRATED SIDE TRACK

(75) Inventors: Teresa Williamson, Marietta, GA (US); Joshua Maust, Roswell, GA (US); Michael Defenbaugh, Dunwoody, GA (US)

(73) Assignee: Newell Window Furnishings, Inc., High Point, NC (US)

( * ) Notice: Subject to any disclaimer, the term of this patent is extended or adjusted under 35 U.S.C. 154(b) by 235 days.

(21) Appl. No.: 13/595,078

(22) Filed: Aug. 27, 2012

Related U.S. Application Data

(60) Provisional application No. 61/528,950, filed on Aug. 30, 2011.

(51) Int. Cl.
*E06B 7/16* (2006.01)
*E06B 7/20* (2006.01)

(52) U.S. Cl.
CPC .... *E06B 7/16* (2013.01); *E06B 7/20* (2013.01)

(58) Field of Classification Search
CPC ..... E06B 7/16; E06B 7/18; E06B 7/23; E06B 7/20; E06B 7/21; E06B 7/215
USPC ..... 160/41, 40, 120, 122, 239
See application file for complete search history.

(56) References Cited

U.S. PATENT DOCUMENTS

| | | | | |
|---|---|---|---|---|
| 483,950 | A * | 10/1892 | Vayre | 160/120 |
| 745,201 | A * | 11/1903 | Kreh et al. | 160/41 |
| 2,417,482 | A * | 3/1947 | Gacki | 396/481 |
| 3,231,006 | A * | 1/1966 | Fisher et al. | 160/41 |
| 3,420,487 | A * | 1/1969 | Larsen | 248/266 |
| 4,374,536 | A | 2/1983 | Becker | |
| 4,649,981 | A | 3/1987 | Bibeau | |
| 4,744,403 | A | 5/1988 | Hausmann et al. | |
| 4,807,686 | A | 2/1989 | Schnebly et al. | |
| 4,945,969 | A | 8/1990 | Schnebly et al. | |
| 5,101,878 | A * | 4/1992 | Thomas | 160/370.22 |
| 5,117,892 | A | 6/1992 | Murray | |
| 5,141,041 | A | 8/1992 | Katz et al. | |
| 5,181,548 | A | 1/1993 | Matthews | |
| 5,526,865 | A | 6/1996 | Coenraets | |
| 5,794,678 | A * | 8/1998 | Beringer et al. | 160/41 |
| 6,035,920 | A | 3/2000 | Lassen et al. | |
| 7,699,088 | B2 * | 4/2010 | Coenraets | 160/113 |
| 2003/0192653 | A1 | 10/2003 | Nien | |
| 2004/0226664 | A1 * | 11/2004 | Lee | 160/89 |
| 2006/0243397 | A1 | 11/2006 | Liang | |
| 2008/0053623 | A1 | 3/2008 | Goldenberg et al. | |
| 2008/0216966 | A1 | 9/2008 | Ben-David | |

(Continued)

FOREIGN PATENT DOCUMENTS

| | | |
|---|---|---|
| EP | 0341760 A2 | 11/1989 |
| EP | 0369068 A1 | 5/1990 |

(Continued)

*Primary Examiner* — Katherine Mitchell
*Assistant Examiner* — Abe Massad
(74) *Attorney, Agent, or Firm* — Dennis J. Williamson; Moore & Van Allen PLLC

(57) ABSTRACT

In one embodiment, a window covering comprises a panel having a lateral edge where the panel is movable between a raised position and a lowered position. A side track is secured to the panel such that as the panel is moved between the raised position and the lowered position the side track is extended along the lateral edge. The side track changes from a first geometry to a second geometry as the side track is extended.

24 Claims, 9 Drawing Sheets

(56) References Cited

U.S. PATENT DOCUMENTS

| | | | | |
|---|---|---|---|---|
| 2008/0303686 | A1 | 12/2008 | Mosbrucker | |
| 2011/0061300 | A1* | 3/2011 | Fisher et al. | 49/70 |
| 2012/0012704 | A1* | 1/2012 | Mosler et al. | 244/118.5 |

FOREIGN PATENT DOCUMENTS

| | | | |
|---|---|---|---|
| EP | 0807199 | A1 | 11/1997 |
| EP | 1045106 | A1 | 10/2000 |
| WO | 9623949 | A1 | 8/1996 |

* cited by examiner

WINDOW COVERING WITH INTEGRATED SIDE TRACK

This application claims benefit of priority under 35 U.S.C. §119(e) to the filing date of to U.S. Provisional Application No. 61/528,950, as filed on Aug. 30, 2011 which is incorporated herein by reference in its entirety.

BACKGROUND

The invention relates, generally, to window coverings such as shades and blinds. Window coverings typically comprise a shade or blind that may be extended and retracted to selectively cover an architectural feature such as a window. Window coverings are typically dimensioned to be used as either an inside mount that is dimensioned to fit within the architectural feature or an outside mount where the blind extends to the outside of the architectural feature.

SUMMARY OF THE INVENTION

In one embodiment, a window covering comprises a panel having a lateral edge where the panel is movable between a raised position and a lowered position. A side track is secured to the panel such that as the panel is moved between the raised position and the lowered position the side track is extended along the lateral edge. The side track changes from a first geometry to a second geometry as the side track is extended.

The second geometry may define a three-dimensional geometry. The panel may comprise one of a roller shade, a slatted blind and a cellular shade. The side track may comprise a material that has shape memory such that the first geometry is a flat shape and the second geometry is a tube. The side track may comprise a thermoplastic reinforced composite. The side track may comprise a material that has shape memory such that the side track curls about two axes with a first axis A-A being disposed substantially parallel to the lateral edge. A second axis B-B may be disposed substantially perpendicular to the first axis A-A. One end of the side track may be connected adjacent a bottom edge of the panel or a top edge of the panel and a second end of the side track may be connected to a take-up mechanism positioned adjacent the other one of the bottom edge of the panel or the top edge of the panel. The panel may be suspended from a support structure and one end of the side track may be connected adjacent a bottom edge of the panel and a second end of the side track may be connected to a take-up mechanism supported adjacent to the support structure. As the bottom edge of the panel is lowered, the side track may be extended from the take-up mechanism such that it extends along the side of the panel. As the side track is extended from the take-up mechanism, the side track may curl about a first axis to create a three dimensional geometry. As the side track is wound on the take-up mechanism, the side track may curl about a second axis into a flat geometry. The take-up mechanism may comprise a roller that is biased to rotate in a first direction. A first portion of the side track may be attached to the lateral edge and a second portion of the side track may be moved away from the panel. The second portion may be moved by a user actuated extender mechanism. The second portion may be moved automatically as the panel is moved between the raised position and the lowered position. One end of the side track may be connected to a take-up mechanism and the second portion may be moved by rotation of the take-up mechanism. The panel may comprise a second lateral edge and a second side track secured to the panel such that as the panel is moved between the raised position and the lowered position the second side track is extended along the second lateral edge such that the second side track changes from a first geometry to a second geometry.

A method of operating a window covering comprises moving a panel having a lateral edge between a raised position and a lowered position; and extending a side track along the lateral edge as the panel is moved between the raised position and the lowered position such that the side track changes from a first geometry to a second geometry as the side track is extended. As the side track is extended the side track may curl about a first axis to create a three dimensional geometry.

DETAILED DESCRIPTION OF EMBODIMENTS OF THE INVENTION

Embodiments of the present invention will be described more fully hereinafter with reference to the accompanying drawings, in which embodiments of the invention are shown. This invention may, however, be embodied in many different forms and should not be construed as limited to the embodiments set forth herein. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" or "front" or "rear" may be used herein to describe a relationship of one element, area or region to another element, area or region as illustrated in the figures. It will be understood that these terms are intended to encompass different orientations of the device in addition to the orientation depicted in the figures.

Figure 1:
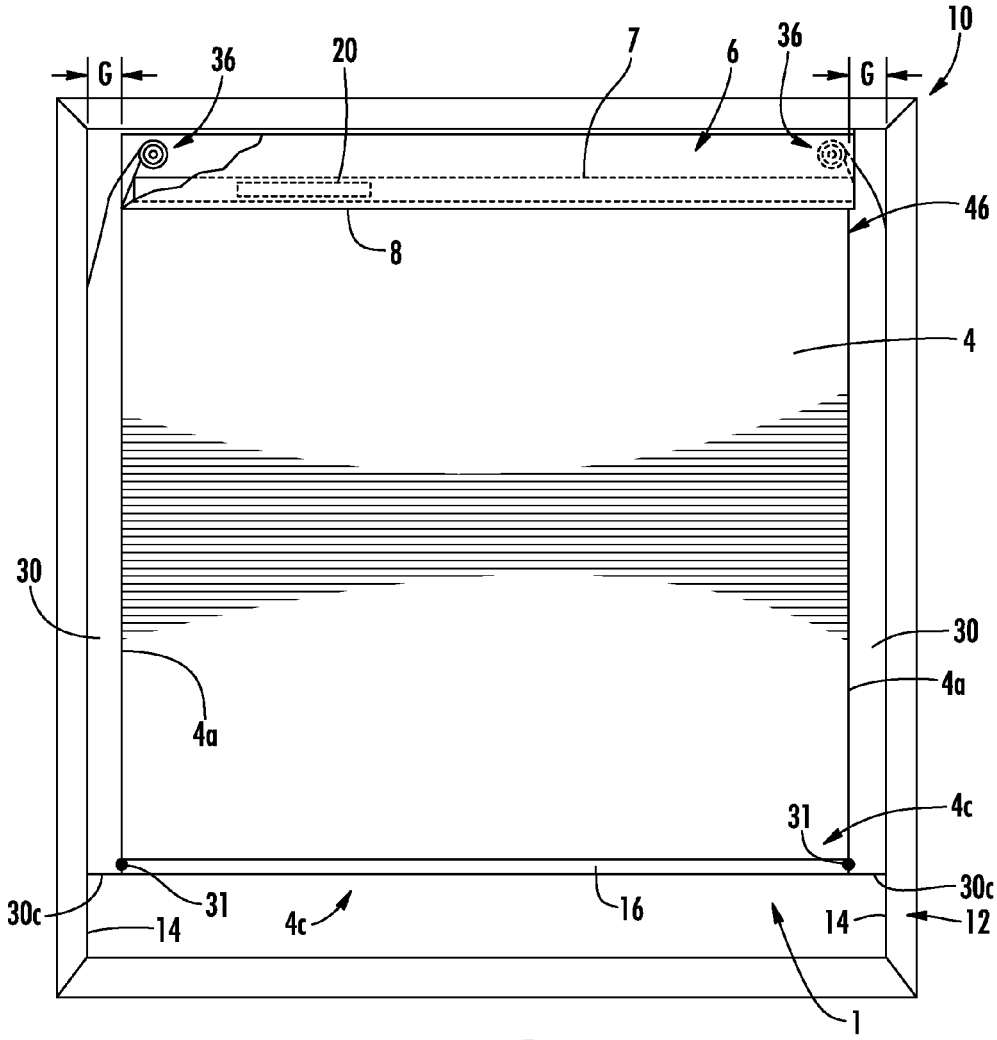
FIG. 1 is a side view of an embodiment of a window covering with an embodiment of the side track of the invention.

The window covering of the invention may comprise a wide variety of window covering styles and configurations including, but not limited to, roller shades, slatted blinds, cellular shades, pleated shades, Roman shades, or other styles and configurations. The window covering may also comprise a wide variety of materials including, but not limited to, textiles, woven or non-woven fabrics, natural fibers such as bamboo, grasses or paper, metal, wood, plastic or other materials. As shown, for example, in FIG. 1, the window covering may comprise a shade panel 4 supported on and suspended from a shade support structure 6 such as a roller, head rail or the like. The window covering may be mounted in an architectural feature 10 and may be extended (lowered) and retracted (raised) such that the panel 4 may cover more or less of the architectural feature as desired by the user. While such window coverings are typically used with windows, the window covering may be used with other architectural features such as doors, alcoves or other features and reference to windows and window coverings is made to simplify the explanation of the invention.

Window coverings may be inside mounts or outside mounts. An outside mount is a window covering that is mounted such that it extends to the outside of and over the architectural feature. Typically, the width of an outside mount window covering is selected such that the edges of the window covering extend beyond the edges of the architectural feature with which it is used. An inside mount is a window covering that is mounted such that it is positioned inside of the architectural feature with which it is used. For example, in a typical window application an inside mount is located within the window frame 12 such that the lateral edges 4*a* of the panel 4 are located between the vertical side walls or trim 14 of the window frame 12. Typically, an inside mount window covering is selected such that the width of the panel 4 is slightly less than the internal width of the window frame 12 or other feature. As a result, gaps G may be created between the edges 4*a* of the panel 4 and the frame 10 such that light and/or air may pass through these gaps. The size of the gaps G may vary based on the style of panel, the fit of the window covering to the architectural feature and other factors. The presence of the gaps may be problematic for light control, thermal insulation and privacy. Side tracks are known that attach to the frame 12 to span these gaps; however, such fixed side tracks require that separate devices be attached to the frame, may inhibit the raising and lowering of the panel, and may be considered to be unaesthetic.

Eliminating the gaps provides a window covering with better light control, thermal insulation properties and privacy. It may be difficult, however, to eliminate these gaps with traditional window coverings for a variety of reasons. For example, some space between the frame 12 and the panel 4 may be required for proper functioning of the window covering. If the panel touches the frame, the panel may bind and fail to raise and/or lower properly. Moreover, all frames are not perfectly square. For these reasons window coverings are typically manufactured in a width that is ⅜ of an inch shorter than the width of the frame to ensure that they may be raised and lowered in the frame. Moreover, with stock size blinds the user must purchase a blind having a width that is closest to, but narrower, than the frame with which it is to be used. Depending upon the available blind widths, a blind may be used that is smaller than the frame. Further, cut-to-size window coverings are typically cut ½ inch shorter in width than the width of the frame. Also, depending upon the window covering style, the support structure for the panel may extend beyond the lateral edges of the panel In the embodiment illustrated in FIG. 1, the window covering 1 is a roller shade and comprises a suspended panel 4 where the panel comprises a relatively flexible panel made of woven or non-woven fabric, plastic, screens, natural materials or other flexible material. The panel 4 has a top edge 4*b* that is supported by the support structure 6 and a bottom edge 4*c* remote from the support structure that may terminate in a bottom rail 16. As used herein the term "bottom edge" includes both the bottom edge of a panel 4 without a bottom rail and the bottom edge of a panel and the bottom rail where a bottom rail is included. In one embodiment the panel support structure 6 may comprise a roller 7 where the panel may be wound on and unwound from the roller 7 to move the panel 4 between retracted (raised) positions and extended (lowered) positions. The roller 7 may be mounted to the architectural feature 10 by brackets or other mounting mechanism. The roller 7 may be provided with an internal or external winding mechanism 20 that is operatively coupled to the roller 7 and may be manipulated by the user to wind and unwind the panel on the roller and to hold the panel and roller in a desired position. The winding mechanism 20 may comprise a spring motor, brake, clutch, ratchet and/or other mechanisms for controlling the rotation of the roller 7, to control the speed at which the roller rotates and to stop the rotation of the roller to hold the shade panel in a desired position. In one embodiment, a spring motor biases the roller 7 in a winding direction such that absent other forces the spring motor rotates the roller in a direction that winds the panel 4 on the roller 7. The user may manipulate the panel 4 to actuate the winding mechanism and raise and lower the panel 4. In other embodiments, the winding mechanism may comprise a cord, chain or the like that is operatively coupled to the roller 7 such that the user may manipulate the cord, chain or other member to rotate the roller 7 to raise and lower the panel 4. In such systems brakes or other devices may be used to hold the panel in the desired position. Many variations in the structure and operation of the roller and winding mechanism may be made. The window covering of FIG. 1 may also be provided with other components 8 such as a valance, enclosed valance, head rail, decorative trim or the like to cover the roller 7 and the take-up mechanisms 36 for the side tracks 30. While a specific embodiment of a window covering is shown and described, the window covering may have a wide variety of constructions and configurations.

Figure 2:
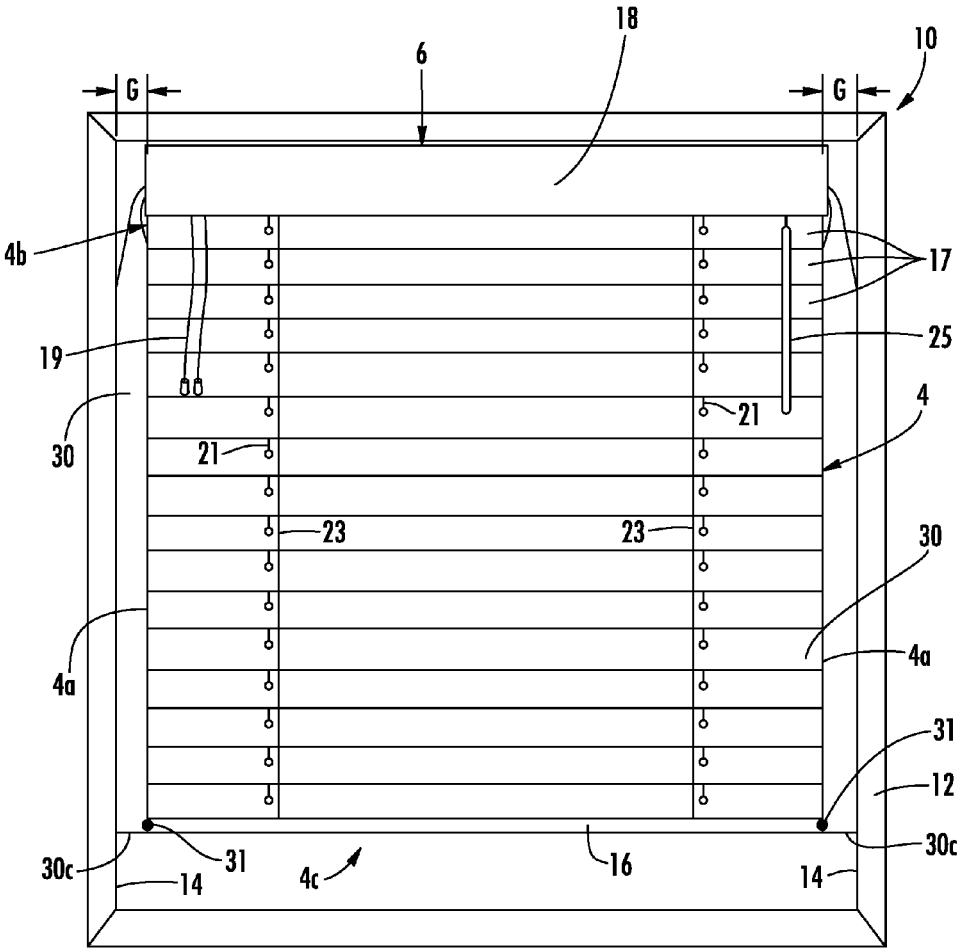
FIG. 2 is a side view of another embodiment of a window covering with an embodiment of the side track of the invention.

Another embodiment of a window covering is shown in FIG. 2 mounted in an architectural feature 10 as previously described. The window covering is a slatted blind where the shade panel 4 is comprised of a plurality of slats 17 suspended from a support structure 6. The slats may be made of wood, polymer, metal or the like and may be provided with a variety of surface finishes. The support structure 6 may comprise a head rail 18 that may be constructed of wood, steel or other rigid material and may be solid or have an interior channel. It is appreciated that, in some embodiments, the term "head rail" need not be limited to a traditional head rail structure and may include any structure, component or components from which a shade may be suspended or supported and which may include the operating system. The head rail 18 may be mounted to the architectural feature 10 by brackets or other mounting mechanism. The panel 4 has a top edge 4*b* that is located adjacent to the head rail 18, a bottom edge 4*c* remote from the head rail 2 that may terminate in a bottom rail 16, and lateral side edges 4*a*.

The shade panel 4 may be supported by lift cords 21 that are connected to or near the bottom edge 4*c* of the panel 4 or to the bottom rail 16. The lift cords 21 may be retracted toward the head rail 18 to raise the panel 4 or extended away from the head rail to lower the panel 4. The lift cords 21 may be operatively connected to an operating system that may be used to raise and lower the shade panel 4. The operating system may be a manual system where the user pulls on cords 19 to raise and lower the panel or a cordless system where the panel is manipulated directly by the user. The operating system may comprise rollers, cord guides, spring motors, cord locks, and other mechanisms to control the raising and lowering of the panel 4. The slats 17 may also be supported by tilt cords 23 that functions to tilt the slats 17 between open positions where the slats 17 are spaced from one another and closed positions where the slats 17 are disposed in an abutting, overlapping manner. The tilt cords 23 may be controlled by a user control 25 such as a control wand or cord that is manipulated by the user to adjust the opening and closing of the slats. While a specific embodiment of a window covering is shown and described, the window covering may have a wide variety of constructions and configurations.

Figure 3:
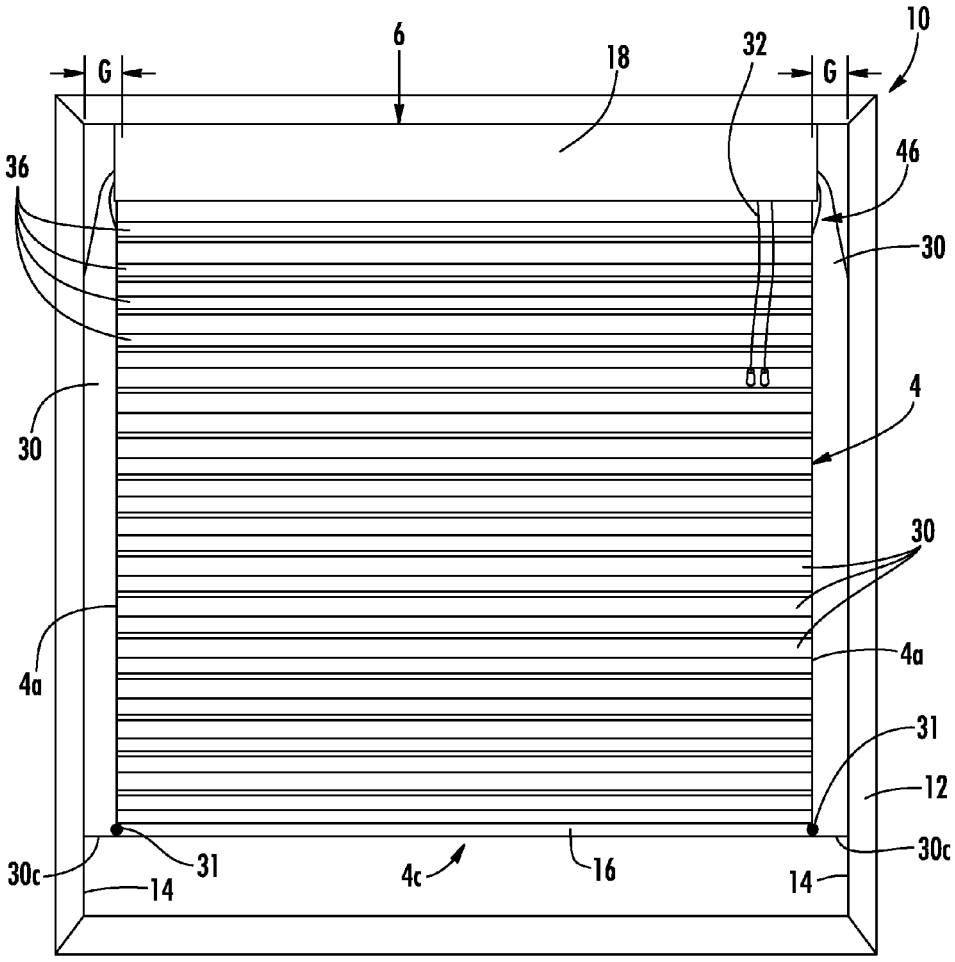
FIG. 3 is a side view of yet another embodiment of a window covering with an embodiment of the side track of the invention.

Another embodiment of a window covering is shown in FIG. 3 and includes a support structure 6 such as a head rail 18. Supported on the head rail 18 is a shade panel 4 comprising a cellular shade consisting of a plurality of cells 36 that extend for the width of the panel. The panel 4 has an upper edge 4*b* that is disposed adjacent head rail 18, a bottom edge 4*c* that may terminate in a bottom rail 16 and lateral side edges 4*a*. The panel 4 may be made of a woven or non-woven fabric, plastic or other material that is constructed to form the substantially contiguous cells 36 where the cells have a polygonal cross-sectional shape and extend substantially parallel to the head rail 18. Each cell 36 may be formed of a plurality of faces that are joined at fold lines such that the cell may have a generally empty interior and can collapse when the shade is retracted and expand when the shade is extended. The cellular panel may be created by any known method and is typically made by stitching, gluing, mechanically fastening or otherwise joining multiple pieces of material together to form the cells. The panel 4 is supported on head rail 18 by lift cords that are connected to the bottom rail 10 and are used to raise and lower the lower edge 4*c* of the panel 4. Typically, the lift cords extend through the cells such that the lift cords are hidden from view. The lift cords extend from the panel 4, into the head rail 18 and the exposed portions 32 are manipulated by the user to raise and lower the bottom edge 4*c* of the panel. The head rail 2 typically includes spools or other mechanisms over which the cords are wound and lock mechanisms for locking the panel 4 in the desired position. The operating system may also be a cordless system where the panel is manipulated directly by the user. While a specific embodiment of a window covering is shown and described, the window covering may have a wide variety of constructions and configurations.

The window covering further comprises side tracks 30 that are integrated with the window covering such that the side tracks form part of, and are supported by, the window covering such that separate side tracks are not connected to frame 12. The side tracks 30 retract when the panel 4 is raised and extend when the panel 4 is lowered. The side tracks 30 fill in the gaps G when the panel 4 is lowered and are hidden from view when the panel 4 is raised. In one embodiment, the side track 30 comprises a member that is rigid enough to form a seal between the lateral edge 4*a* of the panel 4 and the frame 12 when the panel is lowered but is malleable or deformable enough to roll up or otherwise retract when the panel 4 is raised. In one embodiment, the side track 30 is flexible or compressible such that it may be compressed between the lateral edges 4*a* of the panel 4 and the frame 12. A side track 30 may be positioned to extend along each side 4*a* of the panel 4 to fill in the gaps along both sides of the panel.

Figure 4:
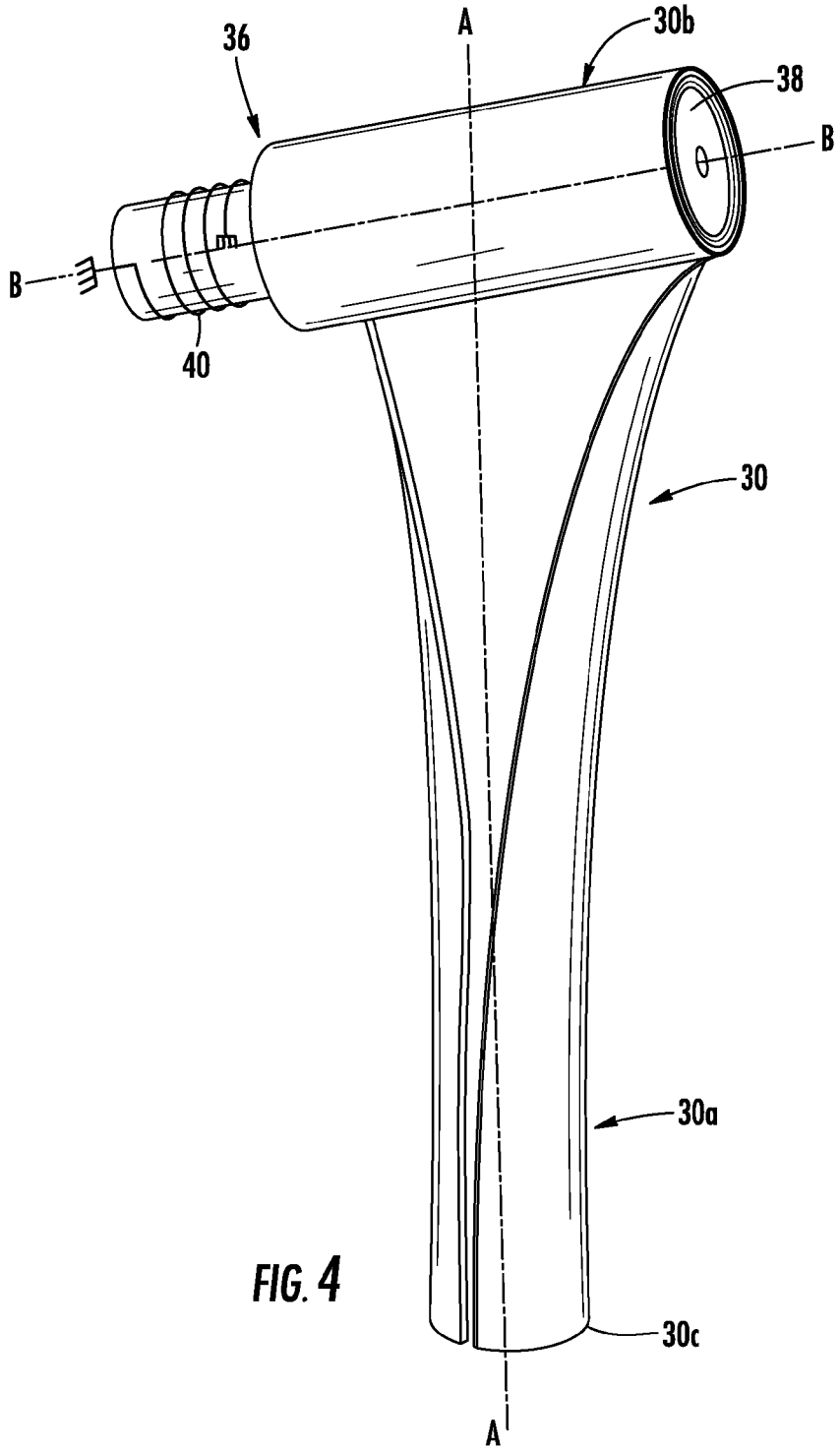
FIG. 4 is a perspective view of an embodiment of the side track of the invention.
Figure 5:
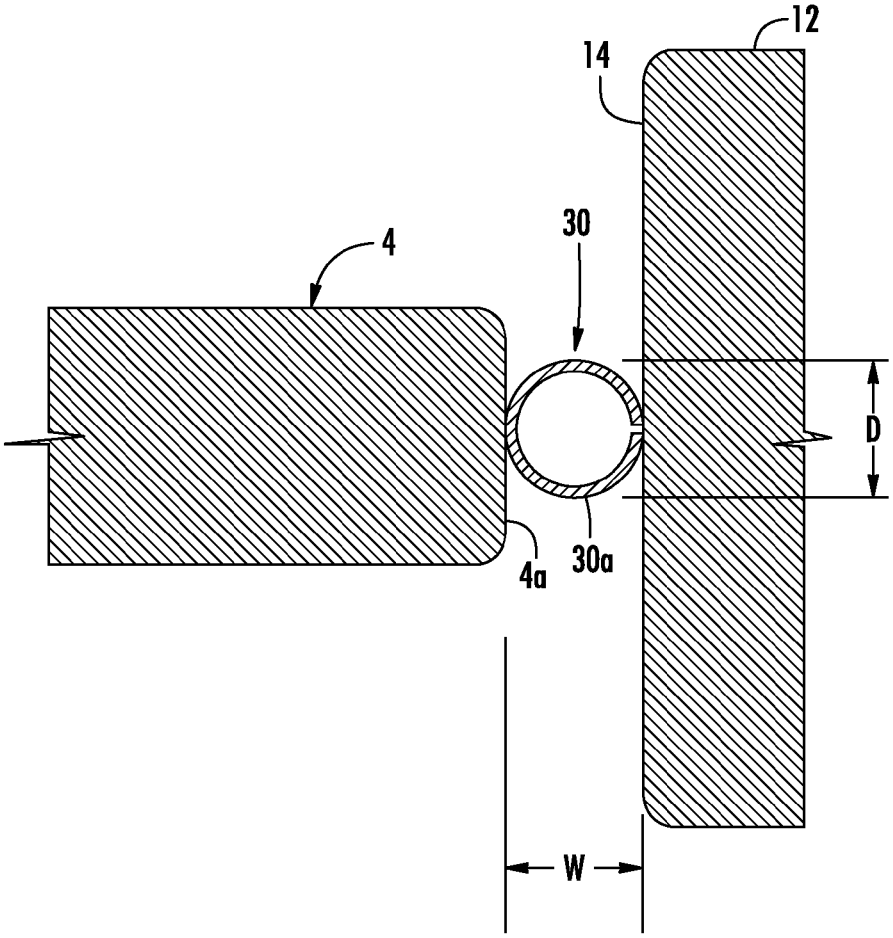
FIG. 5 is a section view of the embodiment of the side track of FIG. 4 in a deployed position.

Referring to FIGS. 4 and 5, in one embodiment the side track 30 comprises a material that has shape memory such that the material may be wound in a first geometry 30*b* that may be a flat shape but when extended assumes a second geometry 30*a* that may be a three-dimensional shape that will fill the gap between the edge 4*a* of the panel 4 and the wall 14 of frame 12. Such materials may comprise thermoplastic reinforced composites. One such material is sold by Rolatube Technology. The material is able to assume a three-dimensional shape when unrolled that has structural rigidity. The material is also able to roll flat and be maintained in a flat rolled configuration without the application of additional forces. Such material may be formed to curl about two axes with one axis A-A being disposed substantially vertically and the other axis B-B being disposed substantially perpendicular to the first axis A-A. Such material is also relatively easy to roll such that minimal force is needed to roll it into a coiled geometry 30*b*. As used herein the term "three-dimensional" means a geometry or shape having a width W and/or depth D of sufficient dimension to fill the gap G as shown in FIG. 5. It is to be understood that the side track 30 has three-dimensions even when rolled flat as shown at 30*b* in FIG. 4; however, in this geometry of the side track does not have a width of a sufficient dimension to span the gap G.

A distal end 30*c* of each side track 30 is connected to or near the bottom edge 4*c* or bottom rail 16 of the panel 4 by a connector 31. The connector 31 may comprise any suitable mechanism including a mechanical fastener, adhesive, stitching or the like. The side track 30 may be attached to the lateral edges 4*a* of the panel 4 at additional points as well. The other end of the side track 30 is connected to a take-up mechanism 36 located adjacent to the top edge 4*b* of panel 4 and may be in or supported by the panel support structure 6. Alternatively, this arrangement may be reversed and the one end 30*c* of the side track 30 may be connected adjacent to the top edge 4*b*, to the support structure 6 or to the top edge 4*b* of the panel 4, and the take-up mechanism 36 may be located adjacent to the bottom edge 4*c*, in or on the bottom rail 16 or to the bottom edge 4*c* of the panel. As the bottom edge 4*c* of the panel 4 is lowered, the side track 30 is extended from the take-up mechanism 36 such that it extends along the side of the panel 4 and is located between the side edge 4*a* of the panel 4 and the frame 12. The side track 30 may abut or be disposed closely adjacent to the panel side edge 4*a* and the frame 12. As the side track 30 is extended it rolls about vertical axis A-A to create a three-dimensional geometry that is positioned between the side edges 4*a* of the panel 4 and the frame 12 as shown in FIG. 5. Using a material having shape memory as described above, the side track 30 may form an elongated tube when expanded. In one embodiment the tube is cylindrical. While the material of the side track 30 in the illustrated embodiment is shaped to form a cylindrical tube when unrolled the material may have other cross-sectional shapes when deployed. Further, while in one embodiment, the memory material in the retracted position is rolled into a flat shape, the material may be other than completely flat provided that the side track 30 may be substantially retracted and hidden from view in when the panel is raised.

Referring to FIG. 4, in one embodiment the take-up mechanism 36 comprises a roller 38 that is biased to rotate in a first direction where the side track 30 is wound on roller 38 to the retracted position 30*b* when the panel 4 is raised. In one embodiment, the roller 38 is biased by a spring 40 although other mechanisms may be used to rotate roller 38 and wind the side track 30 on the roller 38. Because the roller 38 is only required to roll up the side track 30 it may provided with a relatively low biasing force such that the raising and lowering of the panel 4 is not significantly affected.

Figure 6:
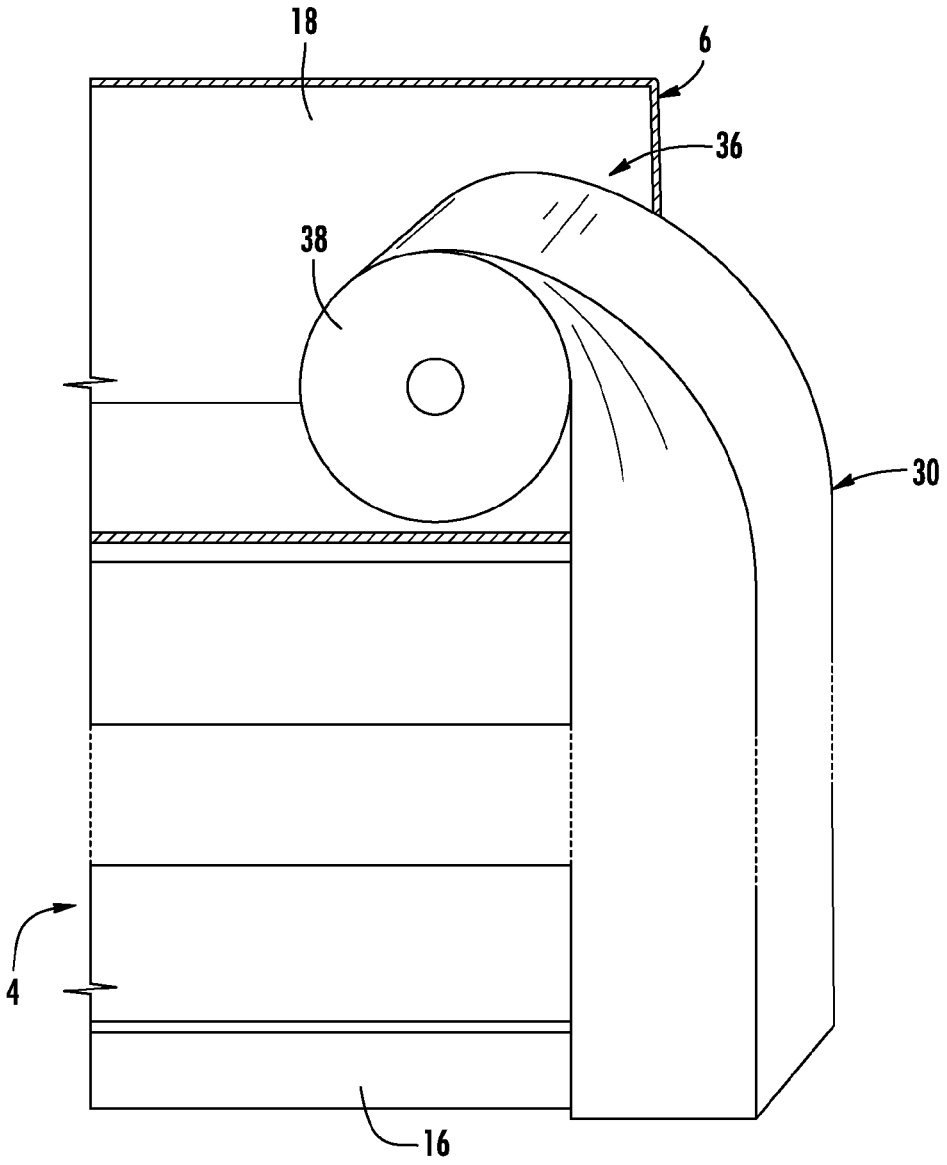
FIG. 6 is a perspective view of another embodiment of the side track of the invention.
Figure 7:
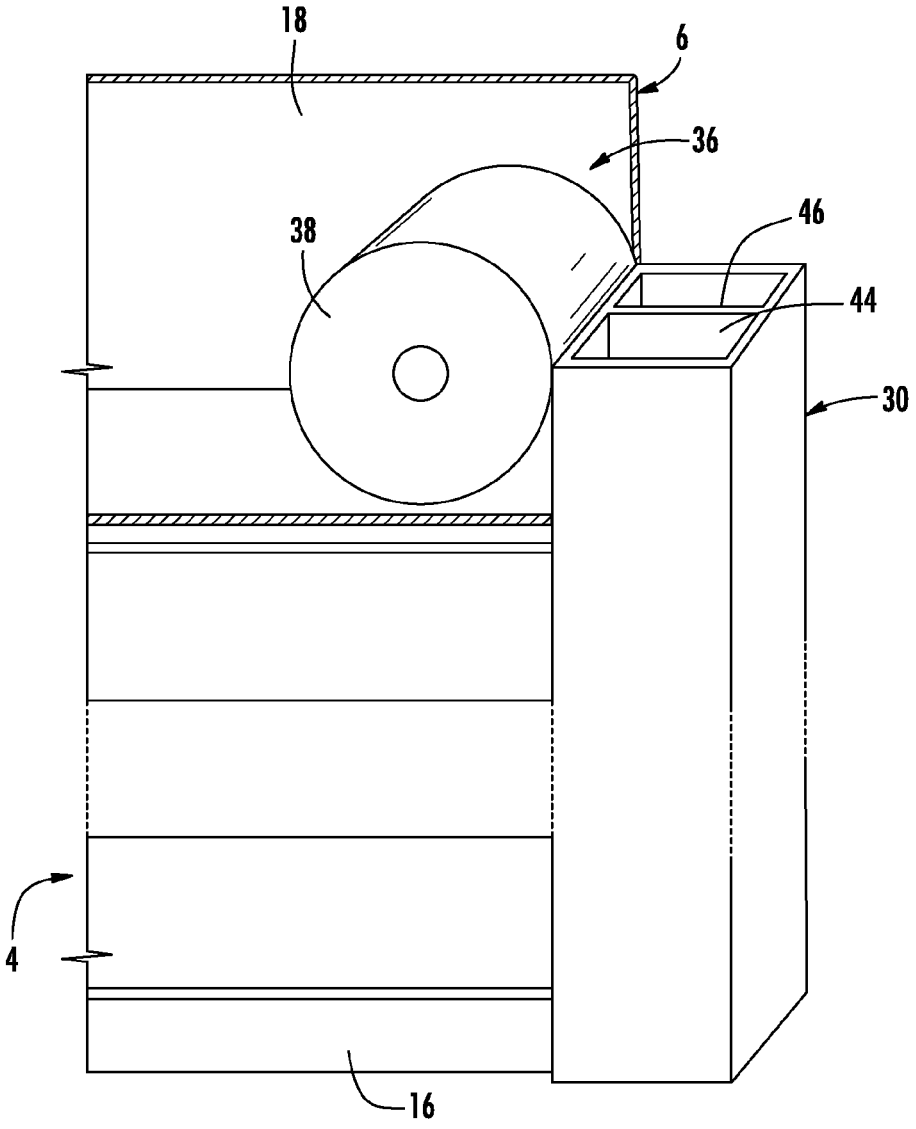
FIG. 7 is a perspective view of still another embodiment of the side track of the invention.

While in one embodiment the integrated side track 30 comprises a material with memory shape made of a thermoplastic reinforced composite or other similar material as previously described, the side track may be made of other materials that may be retracted and stored in a collapsed configuration and unrolled to expand to a three dimensional geometry and fill the gaps to create a light and thermal barrier. As shown in FIG. 6, in another embodiment, the side track 30 may be made of a compressible material 44 such as a soft elastomer. The soft elastomer may be a solid material in cross-section. Alternatively, the side track 30 may use a soft elastomer material where the material forms a generally hollow tube 44. The hollow tube may comprise structural elements 46 that act as spring members. The elements 46 may be formed as one-piece with the hollow tube. The side track 30 may also comprise a soft shell, such as a tube made of nylon or similar fabric, that may be biased to a three-dimensional shape by a separate biasing mechanism such as a coil spring or leaf springs. In these embodiments, the side track may be compressed to a first geometry when retracted, such as by being wound on roller 38 of the take-up mechanism 36, and allowed to expand to a second three-dimensional geometry to fill in, or substantially fill in, the gaps between the lateral edges 4*a* of panel 4 and the frame 10 when the panel 4 is lowered.

Figure 8:
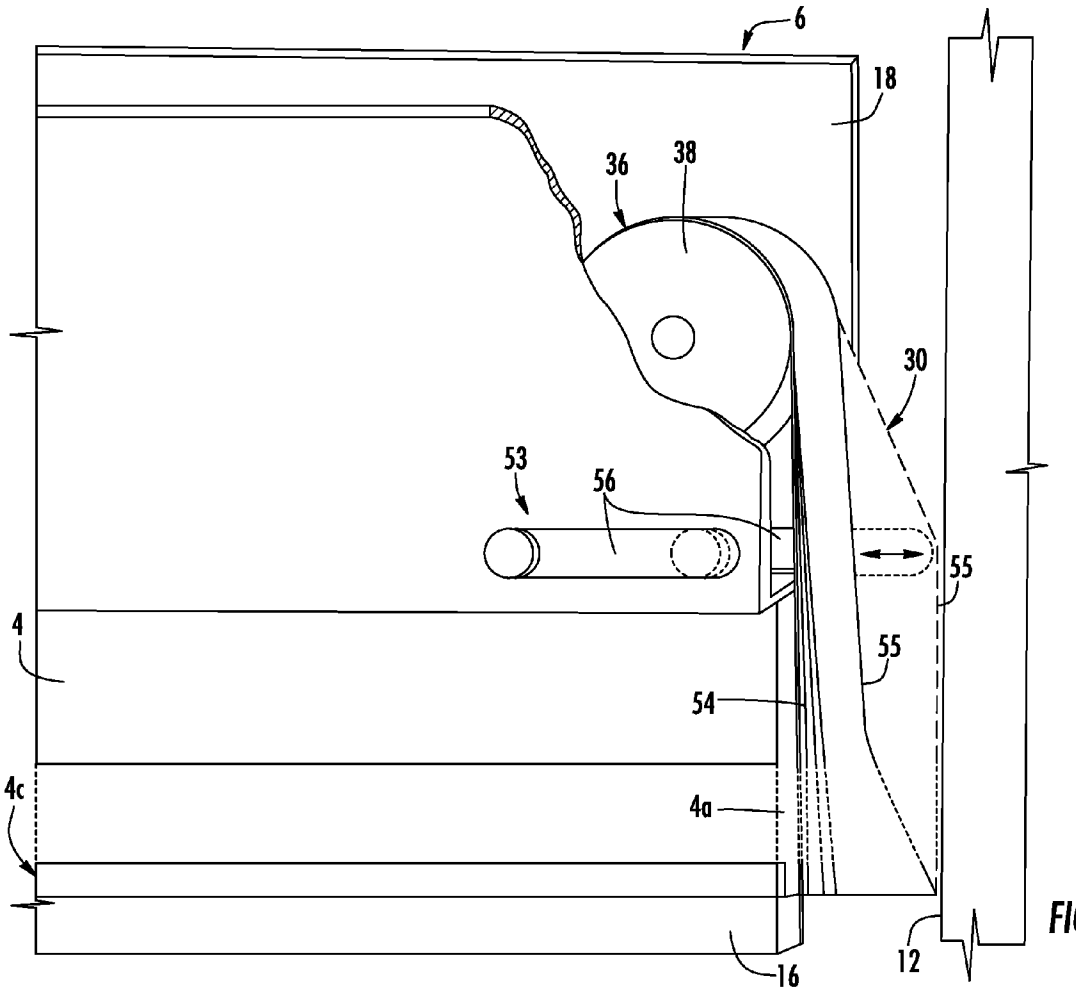
FIG. 8 is a perspective view of yet another embodiment of the side track of the invention.

In yet another embodiment, the side track 30 comprises a soft or pliable material such as a fabric that is dimensioned to fill in the gaps G. Referring to FIG. 8, the distal end of the side track 30 may be attached adjacent to the bottom edge 4*c* of the panel 4, to the bottom edge of the panel 4 or to the bottom rail 16. The upper end of the side track 30 may be mounted on a take-up mechanism 36 located adjacent the top edge 4*b*, such as in or on the head rail 18 or to the top edge 4*b*, such that as the panel 4 is lowered the side track 30 is extended along the side edges 4*a* of the panel 4 and is disposed between the panel 4 and the frame 12. Alternatively, the distal end of the side track 30 may be connected adjacent to the top edge 4*b*, such as to the support structure 6 or to the top edge 4*b* of the panel 4, and the lower end of the side track 30 may be mounted on a take-up mechanism 36 located adjacent the bottom edge 4*c*, such as attached to the bottom edge 4*c* of panel 4 or in the bottom rail 16. One vertical edge 54 of the side track 30 may be attached or sealed to the panel 4 along the lateral side edge 4*a* of the panel. As the panel is lowered an outer vertical edge 55 of the side track is spaced from the frame 12. When the panel 4 reaches a lowered position, the outer vertical edge 55 of the side track 30 is moved outwardly, away from the panel 4, into engagement with, or closely adjacent to, the frame 12. In one embodiment, the side track 30 is extended outwardly by a user actuated extender mechanism 53 such as a lever, slider, pull cord or the like. As shown in FIG. 8, in one embodiment, a lever 56 is mounted in the head rail 18 that is operatively connected to the side track 30. When the side track 30 is in a lowered position, the user moves the lever 56 laterally from a retracted position (solid line) to an extended position (dashed line) to move the outer vertical edge 55 of the side track 30 outwardly toward the frame 12. A locking device may be provided for locking the lever in the extended and/or retracted positions.

Figure 9:
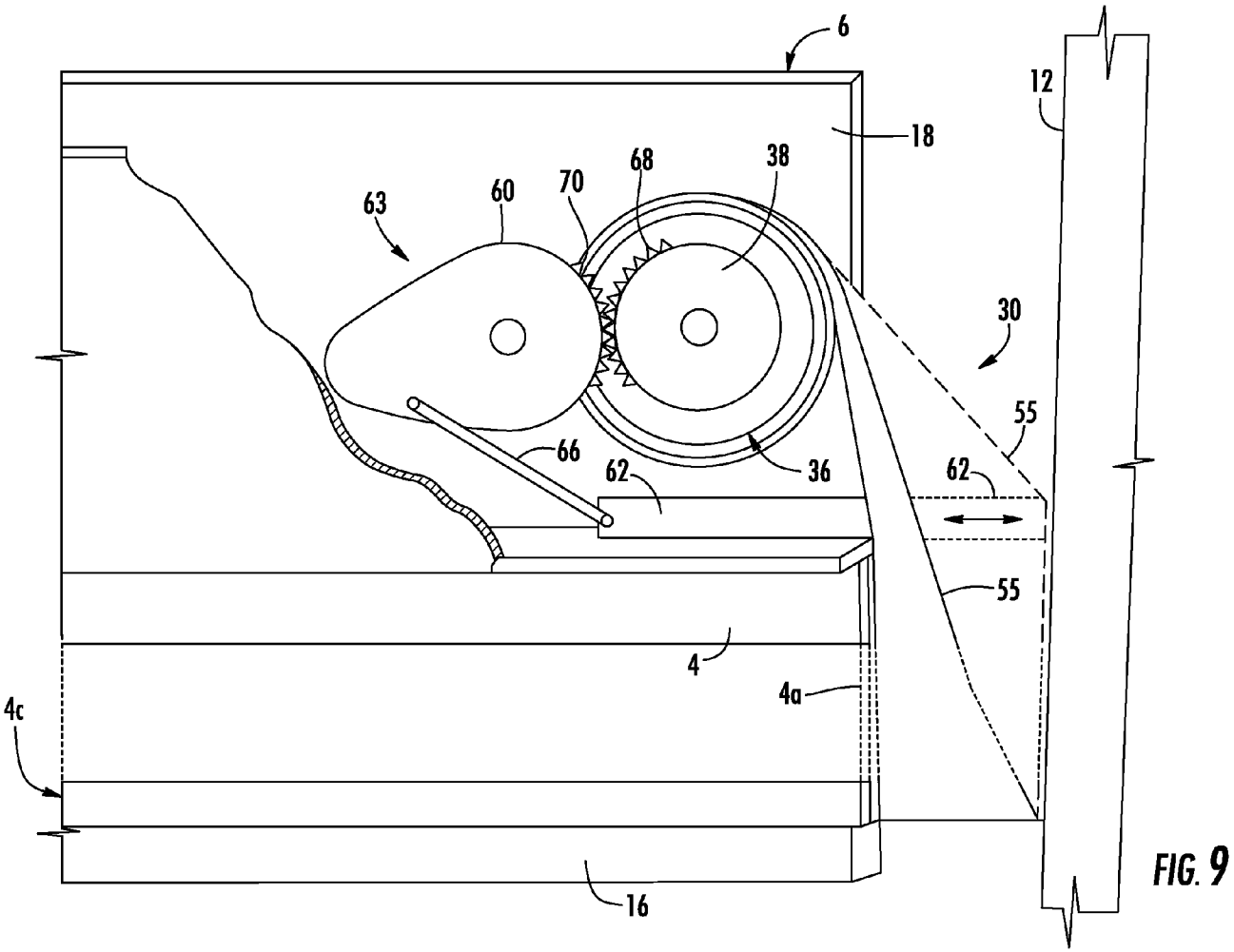
FIG. 9 is a perspective view of another embodiment of the side track of the invention.

In another embodiment the outer vertical edge 55 of the side track 30 may be moved automatically by an automatically operating extender mechanism 63 as the shade is lowered such that the downward movement of the panel 4 moves the outer edge 55 of the side track 30 into engagement with the frame 12. One embodiment of an automatic extender mechanism 63 is shown in FIG. 9. As the side track 30 is lowered, roller 38 of take-up mechanism 36 is rotated causing the eccentric cam member 60 to rotate and move the lever 62 outwardly, via transmission 66, away from the panel 4 and towards the frame 12. The roller 38 may rotate cam member 60 by the engagement of gear 68 on roller 38 with gear 70 on cam member 60. The lever 62 is connected to the outer vertical edge 55 of side track 30 such that the outer edge 55 is moved away from panel 4 and toward the frame 12 as the panel 4 is lowered. The cam member 60 and gears 68 and 70 may be arranged such that the lever 62 is moved gradually toward the frame 10 as the panel is lowered or the cam member 60 and gears 68 and 70 may be arranged such that the lever 62 is moved toward the frame 12 only at or near the end of motion of the panel 4 such as when the panel reaches or almost reaches the completely lowered position.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A window covering comprising:

a panel having a lateral side edge, the panel being movable between a raised position and a lowered position;

a side track secured to the panel such that as the panel is moved between the raised position and the lowered position the side track is extended along the lateral side edge, the side track made of a material that has memory shape such that the side track changes from a first geometry to a second geometry as the side track is extended;

wherein a first end of the side track is connected adjacent a bottom edge of the panel or a top edge of the panel and a second end of the side track is connected to a take-up mechanism positioned adjacent the other one of the bottom edge of the panel or the top edge of the panel, wherein the side track is not connected to the panel between the first end and the second end.

2. The window covering of claim 1 where the second geometry defines a three-dimensional geometry.

3. The window covering of claim 1 where the panel comprises one of a roller shade, a slatted blind and a cellular shade.

4. The window covering of claim 1 where in the first geometry the material is a flat shape and in the second geometry the material is a hollow tube.

5. The window covering of claim 1 where the side track comprises a thermoplastic reinforced composite.

6. The window covering of claim 1 where the side track curls about a first axis and a second axis with the first axis being disposed substantially parallel to the lateral side edge.

7. The window covering of claim 6 wherein the second axis is disposed substantially perpendicular to the first axis.

8. The window covering of claim 1 where the panel is suspended from a support structure and one end of the side track is connected adjacent a bottom edge of the panel and a second end of the side track is connected to a take-up mechanism supported adjacent to the support structure.

9. The window covering of claim 8 wherein as the bottom edge of the panel is lowered, the side track is extended from the take-up mechanism such that it extends along the lateral side edge of the panel.

10. The window covering of claim 8 wherein as the side track is extended from the take-up mechanism the side track curls about a first axis to create a three-dimensional geometry.

11. The window covering of claim 10 wherein as the side track is wound on the take-up mechanism the side track is curls about a second axis into a flat geometry.

12. The window covering of claim 8 wherein the take-up mechanism comprises a roller that is biased to rotate in a first direction.

13. The window covering of claim 1 wherein a first portion of the side track is attached to the lateral side edge and a second portion of the side track is moved away from the panel.

14. The window covering of claim 13 wherein the second portion is moved by a user actuated extender mechanism.

15. The window covering of claim 13 wherein the second portion is moved automatically as the panel is moved between the raised position and the lowered position.

16. The window covering of claim 15 wherein where one end of the side track is connected to the take-up mechanism and the second portion is moved by rotation of the take-up mechanism.

17. The window covering of claim 1 wherein the panel comprises a second lateral side edge and a second side track secured to the panel such that as the panel is moved between the raised position and the lowered position the second side track is extended along the second lateral side edge, the second side track changing from a first geometry to a second geometry as the side track is extended.

18. A method of operating the window covering of claim 1, the method comprising: moving the panel having the lateral side edge between the raised position and the lowered position; extending the side track along the lateral side edge as the panel is moved between the raised position and the lowered position such that the side track changes from the first geometry to the second geometry as the side track is extended.

19. The method of claim 18 wherein as the side track is extended the side track curls about a first axis to create a three-dimensional geometry.

20. The window covering of claim 1 wherein the side track comprises a compressible material.

21. The window covering of claim 20 wherein the compressible material comprises a soft elastomer.

22. The window covering of claim 4 wherein spring members are located in the hollow tube.

23. The window covering of claim 22 wherein spring members are formed as one piece with the hollow tube.

24. A window covering comprising:

a panel having a first lateral side edge and a second lateral side edge defining a width of the panel, the panel being movable between a raised position and a lowered position;

a first side track secured to the panel such that as the panel is moved between the raised position and the lowered position the first side track is extended along the first lateral side edge and a second side track secured to the panel such that as the panel is moved between the raised position and the lowered position the second side track is extended along the second lateral side edge, the first side track and the second side track changing from a first geometry to a second geometry as the first side track and the second side track are extended such that the first side track and the second side track extend outside the width of the panel;

wherein a first end of the first side track is connected adjacent a bottom edge of the panel or a top edge of the panel and a second end of the first side track is connected to a take-up mechanism positioned adjacent the other one of the bottom edge of the panel or the top edge of the panel, wherein the first side track is not connected to the panel between the first end and the second end.

* * * * *